US006513763B1

(12) United States Patent
Ireland

(10) Patent No.: US 6,513,763 B1
(45) Date of Patent: Feb. 4, 2003

(54) MODE-CONVERSION METHOD FOR MODEL RAILROAD DECODERS

(76) Inventor: Anthony John Ireland, 97 Park Dr., Norcross, GA (US) 30071

( * ) Notice: Subject to any disclaimer, the term of this patent is extended or adjusted under 35 U.S.C. 154(b) by 0 days.

(21) Appl. No.: 10/038,310

(22) Filed: Jan. 3, 2002

(51) Int. Cl.[7] ..... B61L 25/00
(52) U.S. Cl. ..... 246/122 R; 318/51; 318/580
(58) Field of Search ..... 105/1.5; 246/122 R, 246/124; 318/580, 587, 51

(56) References Cited

U.S. PATENT DOCUMENTS

| | | | | |
|---|---|---|---|---|
| 4,335,381 A | | 6/1982 | Palmer | |
| 4,341,982 A | | 7/1982 | Lahti | |
| 4,572,996 A | | 2/1986 | Hanschke | |
| 5,773,939 A | * | 6/1998 | Severson et al. | 318/51 |
| 6,220,552 B1 | | 4/2001 | Ireland | |
| 6,318,678 B2 | * | 11/2001 | Ireland | 246/122 R |
| 6,320,346 B1 | | 11/2001 | Graf | |

OTHER PUBLICATIONS

Craig Kosinski, "Carrier Control By–Pass Switch" From Railroad Model Craftsman Magazine, Mar. 1983, 1 page (text and diagrams and picture).

NMRA Recommended Practice RP–9.1–1. Approved Mar. 1997, 6 pages from NMRA.org Website.

* cited by examiner

*Primary Examiner*—S. Joseph Morano
*Assistant Examiner*—Lars A. Olson

(57) ABSTRACT

A method and apparatus to allow compatible speed operations and physical coupling of decoder equipped locomotives to locomotives without decoders when operating on conventional track power. The improvements utilize mechanisms added to improve decoder fault protection, and that can also be usefully additionally employed to allow voltage accurate mode-conversion using a novel, cost reduced and simplified mode-switching arrangement. Additionally, a convenient automation of the mode switching arrangement is shown by using different relay switch configurations controlled by the decoder logic.

19 Claims, 3 Drawing Sheets

MODE-CONVERSION METHOD FOR MODEL RAILROAD DECODERS

BACKGROUND OF INVENTION

This invention pertains to the field of control systems for scale model railroad layouts, and specifically to improvements in locomotive decoder (receiver) device interface connections and mode-conversion capabilities.

The advent of Command Control technologies has led to increased enjoyment and capabilities for model railroaders and their operations of model railroad layouts. Since the early Carrier Control systems of the 1970's and up to the latest Digital Command Control technologies, the key capability of all the technologies is the same. This is the ability to control multiple independently addressed locomotives in the same electrical section of model railroad tracks. All the technologies that communicate these addressed commands to a particular receiver, or decoder, in the locomotive by electrical conduction via the rails employ some variant of encoded time-varying voltage waveforms, and are termed Command Control systems. Additionally, some 1990's prior art Command Control systems have been developed that control decoders via a Radio Frequency link or an Infra Red data link, with energy supplied via the track or batteries, and these variants can be also considered to behave in a similar manner and scope to the systems discussed herein. As technology and miniaturization have improved, the encoding methods, features and capabilities have been upgraded, but the net effect is still fundamentally that of allowing multiple simultaneous train control capability in at least a single track-section. This is a capability that no earlier "conventional" AC or DC power-pack systems possessed and is why these older single-control per track systems have been surpassed by Command Control methods.

The earliest GE "Astrac" system was one of the first "frequency modulated" waveform train Command Control systems, along with the methods employed by Lahti in U.S. Pat. No. 4,341,982. In the early 1980's the Hornby "Zero-One" system, as taught by Palmer in U.S. Pat. No. 4,335,381, provided one of the first examples of a modem Digital Command Control, or DCC, system with digital command encoding methods that are direct precursors of the latest message-based Digital Command Control art. Additionally, the Marklin "AC Digital" or Trinary DCC system was also introduced in the mid-1980's, and is taught by Hanschke in U.S. Pat. No. 4,572,996.

The freedom to operate multiple receiver, or decoder, equipped locomotives then raised a further novel question of interchange of and coupling of different technology locomotives on and between layouts equipped with the exciting technologies of, Command Control, Digital Command Control or Carrier Control and other conventional layouts and locomotives without these new capabilities. These different modes of operations are not inherently compatible.

One of the earliest widely known publications to identify this equipment interchange and compatibility issue was by Craig Kosinski in a March 1983 Railroad Model Craftsman magazine article. In this article Kosinski clearly identifies the problem of running the "new" Carrier Control (also often termed Command Control) technology steam locomotives on a conventional DC controlled layout, with other DC controlled locomotives or trains. Kosinski proposes an obvious and simple functional solution to the problem. Kosinski teaches the addition of a double-pole double-throw (two configurations) "changeover" style switch to bypass the receiver, or decoder, and allow the locomotive motor to be fed directly from the track power or energy source. As Kosinski states, this allows "making the control system optional", and neatly solves the interchange dilemma between different control technology locomotives and layouts. With the decoder bypassed, the motor allows the locomotive to act in tandem and to be safely coupled with other DC motor locomotives, in a wholly compatible manner. The extension of this bypass switch method to be used with locomotives from DCC systems such as "Zero-One" is also noted, along with cautions for incorrect switch settings. Note that in this configuration the two motor leads are switched, each by an individual switch pole, and there are two current carrying positions for each motor lead switch pole. All six leads of the switch are involved in power (or energy) conduction, and the locomotive motor selectively receives energy from either the energized decoder or directly from the tracks, but not both the decoder and the track energy source simultaneously.

The problem of interchange between DCC decoder equipped locomotives onto DC systems, and also the reversed situation of operating DC locomotives on DCC systems, was also addressed by systems based on the public domain NMRA DCC Standards, introduced in the early 1990's, and based on the earlier Marklin "DC Digital" system. In particular, the NMRA DCC technology allowed for automatic, or selectable, Power Mode-conversion options that allowed the decoder to detect that it was connected to a conventional track energy supply, or other control method, rather than a compatible DCC encoded control system. Accordingly when the decoder or receiver detects the tracks being driven by a conventional power system it modulates the H-bridge motor drive circuit so as to supply the input power directly to the motor. The speed of the motor is then mainly controlled by the amount of conventional voltage supplied and is further usefully modified by decoder actions. The NMRA prior art uses the term "mode-conversion" to describe the action of a decoder, or other control device, that detects a change of the nature of the track energy supply it is connected to then allows a change of control action or strategy based on the new type of energy supply.

While in this non-DCC mode-conversion state, the 1990's prior art decoders continue to enjoy useful DCC benefits, such as; Digitrax FX lighting effects like "Mars lights" enabled while in conventional mode by NMRA Configuration Variable CV13, the simulated Braking and Acceleration momentum effects specified by NMRA Configuration Variables CV04 and CV03 respectively, over-temperature and overcurrent protection logic and many other capabilities such as decoder data feedback or transponding.

Since all decoders employ an input-rectifying bridge circuit (to allow locomotive placement or connection to the track in either direction) the motor H-bridge power 95 supplied as the output of this input-rectifying bridge circuit removes the direction control information implicit in the track conventional DC polarity control. The decoder control logic additionally now has to sense the DC polarity of the tracks prior to the input-rectifying bridge circuit and then appropriately modulate the H-bridge motor drive circuit to faithfully reproduce the intended motor and movement direction. This automated mode-conversion or power pass-through and direction determination was also extended to conventional AC control systems. In the 1990's commercial DCC decoders were produced that could sense the higher voltage direction reversing pulse used by Marklin conventional AC power packs to change direction, or the power cycling sequence used by Lionel ZW type of AC controlled locomotives to discriminate the correct direction commanded. In some decoders the programming or switch-configuring of decoder address to 00 (not a unique control address) forces the decoder to remain in the conventional power or energy pass-through control state.

The converse state of operating a DC locomotive on a DCC equipped track was also made possible with the Analog mode "zero-bit stretching" allowed by the NMRA DCC Standard.

The goal of all these products, efforts and technologies employed all through the 1990's was to allow decoder equipped locomotives to operate with compatibility on conventional control systems (and vice-versa) and allow trains and multiple-unit locomotive "lash-ups", or consists, to be freely formed with a mixture of different technology locomotives.

The ubiquitous presence in decoders of the input-rectifying bridge circuit and the H-bridge motor drive circuits cause a problem, in that the decoder equipped locomotives necessarily will run at a slower speed than unconverted conventional locomotives when on a conventional layout. Here the decoder-equipped locomotives will not accurately or compatibly respond to the desired conventional mode speeds commanded to other conventional locomotives by the conventional track energy supply. This inaccurate mode-converted response of decoder equipped locomotives to conventional control voltages means that it is problematic to physically consist, or couple, conventional locomotives to decoder equipped locomotives that do not employ voltage accurate mode-conversion.

This is due to the fact that the input-rectifying bridge circuit has significant semiconductor diode forward conduction voltage drops of about 2×0.7 Volts=1.4 Volts. More significantly, the typical modern Field Effect Transistors (MOSFETs) employed in the motor H-bridge drive circuits need several volts of control gate input voltage to allow significant motor current conduction. Also, the control logic, or even microprocessor controller CPU, typically needs 2 or more volts to become functional. This means that a decoder that mode-converts on DC track will not even start to allow motor movement before the DC voltage is about 3 or 4 volts or more, and then the motor running voltage will be several volts less than a comparable motor in a conventional non-decoder locomotive. Clearly a decoder equipped locomotive can be run on a conventional layout, but a consist or multiple unit "lash-up" or tandem operation cooperating with conventional locomotives is problematic. This difference of voltage accuracy in decoders responding to conventional control voltages has been widely known since the early 1990's. Of course, when running on a conventional layout, the decoder equipped locomotives can offer no additional independent multiple-train control capability beyond that created by the power switching and track "block control" employed on those conventional layouts.

The NMRA adopted a Recommended Practice (RP) in the mid- 1990's with a switch-plug arrangement as NMRA Recommended Practice RP-9.1.1, and this is often used to address this speed accuracy or voltage disparity problem, as well as make a decoder convenient to install and uninstall. This RP allows a multi-pin plug arrangement installed in the locomotive to select the bypass "conventional" mode using a "shorting plug" to connect the motor to receive energy only from the track pickups, or be mutually exclusively switched to a decoder plug to allow the motor to receive energy only from the decoder. This switching is specifically arranged such that it is not possible for the motor to be connected to, or receive energy from, both sources simultaneously, even when the decoder resides inside the locomotive. This arrangement has provided for and has been commonly used for many years in the 1990's by model railroad clubs and individuals with HO scale locomotives to allow for switching back a decoder equipped locomotive to run properly and accurately on a conventional layout. This is also a method that is directly related to and clearly anticipated by Kosinski, since a motor double-pole changeover switch arrangement is created with two different and distinct switch states (two configurations) that both carry the load current, and this intentionally allows "making the control system optional" for mixed locomotive technology operations.

In 1995 Digitrax Inc. introduced the DH84 DCC decoder with an integral 9-pin JST connector and a matching inexpensive harness system and shorting plug arrangement that was designed to allow the relatively expensive decoder to be shared amongst many harnessed locomotives. The consumers appreciated the cost savings, and could typically use a ratio of four or ten harnessed locomotives to one decoder, and this allowed large fleets of locomotives to selectively enjoy the benefit of DCC operations at an affordable cost. This greatly reduced resistance to conversions of layouts to DCC technology. The locomotives without a decoder plugged in would have a matching shorting "jumper" plug installed that would allow accurate and compatible motor operation on conventional DC layouts or even operation on zero-stretched DCC layouts. Model railroad clubs frequently use this capability since they often partition the layout into DCC and conventional DC controlled areas to satisfy members' preferences. This technique is analogous and functionally equivalent to the NMRA RP-9.1.1 locomotive socket method, but was intended for locomotives that were not originally manufactured with an integral NMRA decoder socket. It is thus, also considered a logical derivative of Kosinski, and in fact was so popular that the NMRA incorporated the 9-pin JST variation into a revision of RP-9.1.1 several years after the DH84 was introduced. Interestingly, many users would employ the DC shorting "jumper" plug for DC layout operations to get best voltage accuracy, even though the DH84 itself embodied automatic detection and mode-conversion for DC layout operations.

The November 2000 Graf U.S. Pat. No. 6,320,346 covers this same ground and capability as taught by the just outlined and widely documented prior art. Unfortunately, Graf does not disclose the full extent and body of prior knowledge, techniques and efforts widely known in the industry as relevant to mode-conversion or switching methods. In particular, Graf only shows the use of a double-pole double-throw (two configurations) or "changeover" style switch (or equivalent relay or contactor) to select the source of the energy supplied to the motor.

The switch arrangement shown and claimed only allows motor energy to be provided selectively and mutually exclusively by either a first decoder connected configuration or by a second track connected configuration. All six terminals of the changeover switch are used to carry currents. This technique is clearly anticipated by Kosinski and NMRA RP-9.1.1 The lack of research into, or knowledge of, the prior art leaves the Graf method without a clear and reasoned distinction over demonstrated prior art, and the obviousness and lack of novelty raises doubts as to the validity of the Graf Patent.

Interestingly the methods taught by Kosinski and RP-9.1.1 and used by Graf are not the most optimal, simplest or most cost-effective methods to allow accurate mode-conversion of decoder equipped locomotives.

Additionally, if the changeover switch is implemented with the obvious electrical equivalent of a relay switch or electrical contactor, as suggested by Graf, there is a significant problem when attempting to Service Mode Program using the commonly required NMRA RP-9.2.3 DCC programming method to configure Configuration Variables (CVs) in the DCC decoder. A typical HO or N scale locomotive motor presents about a 10 to 15 ohm impedance, and yields from about ½ to 1 ampere when stopped and connected to a track voltage of about 12 Volts, typically used by a programmer. If the unpowered, or unoperated, Relay State connects the motor to the programming-track energy source, the locomotive installation presents an excessive power load to the programming-track; defined by the RP-9.2.3 as current greater than 0.25 Amperes after power on. Since the motor load is also typically used to signal programming success, or current pulse acknowledgement, and will often cause a collapse of the programming-track voltage due to required overcurrent fault protection, the premature and permanent operation of the motor will defeat reliable programming on necessarily power-limited programming-tracks specified by the NMRA RP-9.2.3.

If the relay unpowered state does not connect the motor to the track, then on a conventional track accurate mode-conversion is not possible since the relay cannot be operated until the track voltage raises sufficiently for the decoder control logic to work and then operate the relay. Ironically this is the exact problem the changeover switch method was intended to fix.

Graf fails to identify the existence of this major RP-9.2.3 programming problem when using a relay switch mechanism or to teach how this may be overcome. Additionally Graf fails to teach how the relay is energized and the logic by which it is controlled.

The prior art citations of mode-conversion technology, operating methods and decoder and DCC product design strategies presented are illustrative of the art and are considered incorporated herein by reference. In particular, the drawings of Graf depict a typical low-end decoder design with configurations of circuitry, or close functional derivatives, commonly found in many types of decoders.

The lowest cost switches, miniature DIP switches and miniature Reed relays suitable for the required motor current switching for voltage accurate mode-conversion, are configured as simple make-break (reed relay "form A") contact units, and not the more complex and expensive changeover (reed relay "form C") contact styles that are required for the prior art.

An invention that allows the (voltage) accurate mode-conversion of a DCC equipped locomotive using simpler and less expensive make-break types of switches, and that can operate on a power-limited programming-track is a valuable addition to an improvement over the prior art of model railroad control.

SUMMARY OF INVENTION

Since 1997 Digitrax Inc. has produced DCC decoders with the unique ability to test the state of the motor isolation from the track connections at initial power-on. This is a novel fault detection method that finds and protects against the most common reason that decoder installations fail. This is the failure by the installer to remove the original locomotive motor to track connections from both of the motor leads correctly and hence allow the motor to powered solely by the decoder H-bridge output circuit. If any failure of isolation is detected, the Digitrax decoder will disable the H-bridge output circuit from driving the motor and no damage can occur to the H-bridge or decoder, since it will not be able to conflict with the track energy source, even though the decoder and H-bridge are also being powered by the track energy. It is also possible for the decoder to signal this measured and assumed fault state by blinking lights in a distinctive manner.

This protection method is very useful in allowing for a new and innovative way of forcing an accurate mode-conversion capability on the decoder. Since the motor leads may be selectively connected by simple jumpers to both the track and the decoder H-bridge output connections at the same time, without damaging the decoder, it is possible to use this direct metallic jumper connection to allow the motor to run accurately on conventional track power or energy. Since the decoder actively detects this state and responds in a safe and suitable manner, no ill effects will occur when the track power is also simultaneously jumper-connected to the motor in this manner, and the normal higher startup voltage of the decoder will not affect the accuracy of the motor speed operation. The unpowered state of the decoder and H-bridge is designed to be nonconductive to the motor output terminals. When the conventional track power is sufficient for the decoder to begin operation, the motor will typically already be in motion and the decoder will detect the track-motor jumpers and decline to operate the H-bridge output.

The decoder then knows that the motor is intended to run directly from track power and can analyze the track voltage encoding to provide any sensible possible supplementary control actions.

When operating in this state the decoder can still analyze the track voltage waveform to infer conventional operating direction, speed etc., and so can still operate other non-motor features such as; directional lights, FX lighting effect functions and any other capabilities such as data feedback of input lines, distance or location localizing Transponding, as taught in U.S. Pat. No. 6,220,552. Sound capable decoders can operate sound generation when the voltage is sufficient, and can even generate an alarm sound indication if the detected mode and track voltage is calculated to possibly permit damage to the motor. Sound synchronization cams and speed-varied sound are still operable by the decoder measuring the track voltages or timing cam inputs.

This new configuration disclosed herein is distinctly different to that of Kosinski, NMRA RP-9.1.1 and Graf, in that the decoder is definitely powered simultaneously to the motor and the decoder H-bridge output circuit is also always connected to the motor leads, irrespective of whether or not the track energy is also connected to the motor. This new configuration only needs two simple and inexpensive make-break jumpers or switch connections, and only four connection points are used to switch the currents, unlike the 6 connection points per switch of the double-pole changeover types of arrangements used in the prior art. This minimizes; the number of current carrying terminals, wire connections needed, Printed Circuit Board connection area and also improves reliability. This also allows the use of lower cost make-break or single throw type standard DIP switches or "form A" reed relays to effect the conversion.

This invention is not intended to be solely limited to DCC encoding format decoders, and may be employed in any type of decoder or receiver used for model layout control purposes by those skilled in the art of electronic circuit and control software design using the methods presented herein.

ATTACHED DRAWINGS 2 sheets

FIG. 1 details the typical connection arrangement of the elements of the prior art.

FIG. 2 details the typical connection arrangement of the elements of the preferred embodiment.

FIG. 3 details an electrical schematic of electronic elements for the preferred embodiment.

DETAILED DESCRIPTION OF INVENTION

Item 1 represents the decoder, receiver or electronic control unit that may be used to control the motor, 8, when any track energy supply, 12, connected to the model railroad tracks, 2, provides a compatible and understood control format. The track energy and embedded control information, from 12 via track 2, is conducted by track pickup leads 3 and 4 and conducted to the decoder, 1, and also to a motor current switching arrangement, 7. The track pickup leads 3 and 4, may be via locomotive wheels, track slider shoes, pickup brushes, overhead pantograph pickups or any other conductive method or combination, and may even be via a wired-tether connection.

Figure 1:
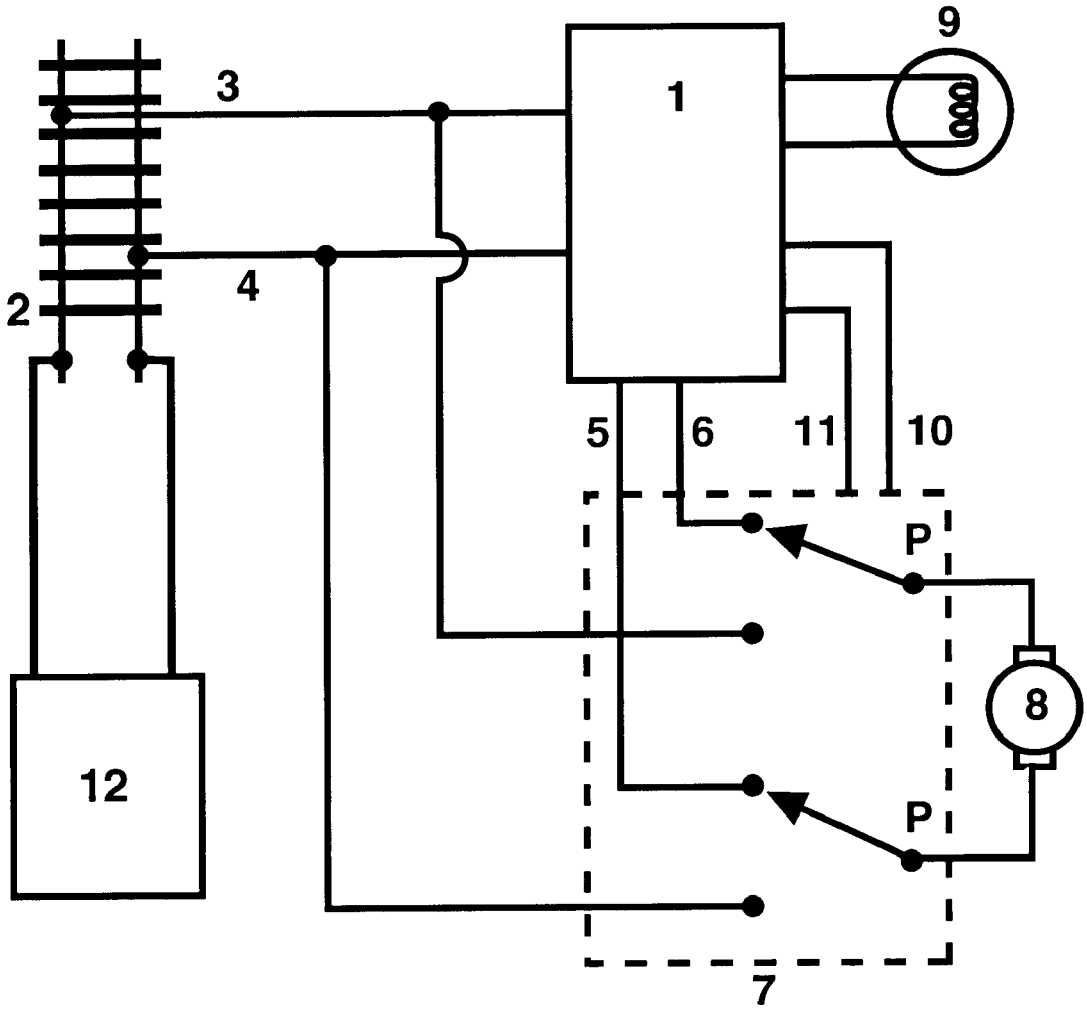
FIG. 1 depicts many key elements of the general electrical connection arrangement of the prior art of RP-9.1.1 and also represents some of the configuration described by Graf.

The motor current switching arrangement, 7, is enclosed in a dashed box to signify that it operates in a unified manner as a logical control or selection element, even though it is actually composed of multiple conductive and insulative components and connections. Item 7 has two distinct control states, or switch configurations. The first configuration, shown in FIG. 1, is where the two leads of the motor, 8, are connected via each of the two different switch common poles, marked P, to the decoder H bridge output leads 5 and 6. This "decoder mode" configuration allows the decoder, 1, to be in sole control of the motor energization or motion by any control algorithm the decoder is programmed to employ. Note that the wiring arrangement of 7 precludes the decoder output leads, 5 and 6, being directly connected to the track pickup leads, 3 and 4, since neither these two lead pairs are wired directly to the switch common poles, P.

The double-pole changeover arrangement of 7 may be exactly created by a Double-Pole Double-Throw (DPDT) Switch, DPDT relay or contactor contacts, or even by a socket and two-plug arrangement used by NMRA RP-9.1.1 All these arrangements or variations, including the DPDT changeover switch taught first by Kosinski, operate in the same manner; to allow the motor energy source to be selectable, to allow voltage accurate mode-conversion when the motor is directly powered by the track, and to not allow the possibility of the decoder powering the motor at the same time as the track.

The second configuration of item 7 is the "track mode", where the motor leads are alternately connected directly to the track pickup leads, 3 and 4. This is not shown by FIG. 1, but is when the two arrowed switching connections from the poles, P, are in the lower position, routing track power directly to the motor, and bypassing the decoder output leads. Here the track power directly controls the motor motion, allowing voltage accurate mode conversion on conventional track energy, which is not affected by voltage or energy losses in the decoder.

Item 9 indicates a decoder controlled light function, as also described by Graf and incorporated by most locomotive decoders built since the 1980's, notably those that also allow automatic mode-conversion with conventionally operative light functions and lighting effects.

Figure 2:
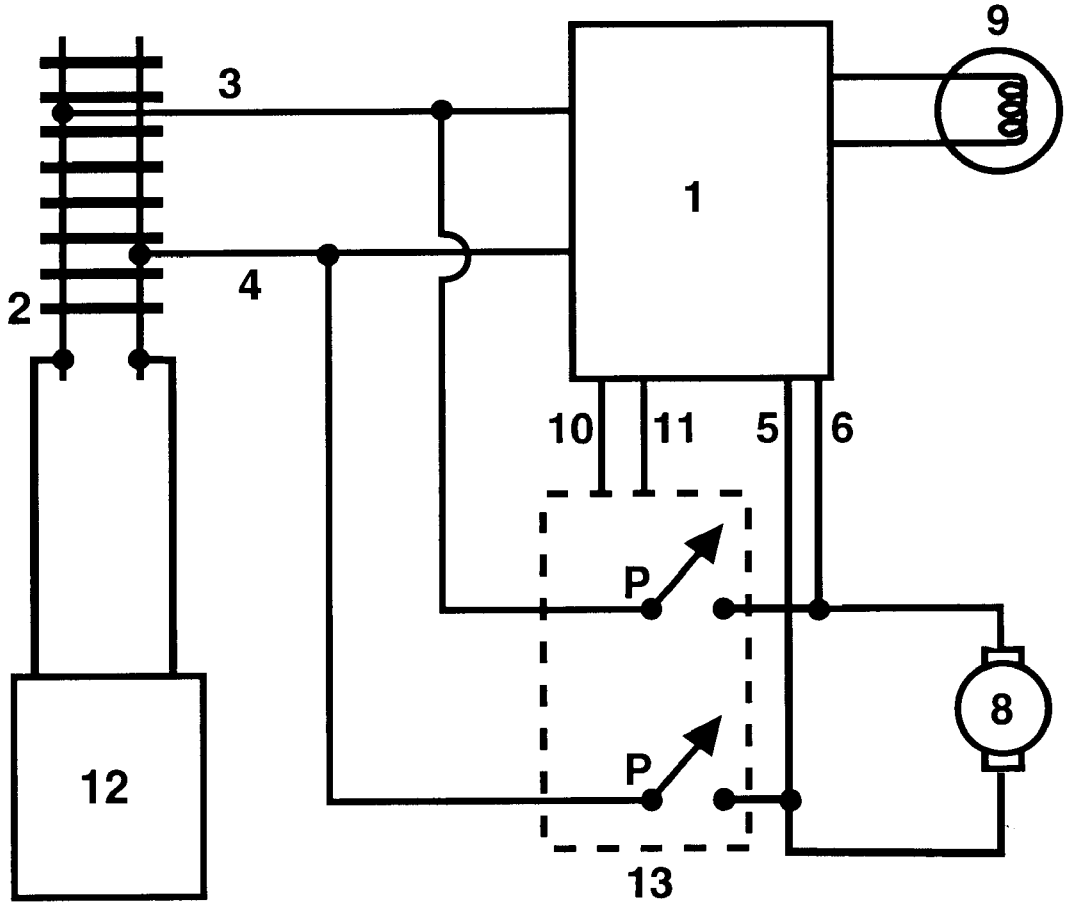
FIG. 2 shows these same elements in the novel configuration employed in the preferred embodiment of this invention.

FIG. 2 shows elements of the prior art, and those shown by Graf, arranged in a new and improved manner. In FIG. 2 the decoder, 1, also has a fixed electrical connection via 3 and 4 to the track, 2, and the track energy supply, 12. However the mode switch arrangement, 13, is different to that employed Graf, 7, and RP-9.1.1. Mode switch 13 has two poles denoted P, but is made up of two simpler make-break electrical contacts. For this new art to be operable, the decoder must employ output voltage state detection of the decoder H-bridge output leads, 5 and 6. The additional logic needed to output voltage state detection in a decoder is detailed in FIG. 3.

Note that it is advantageous for any decoder to employ this to output voltage state detection for purely reliability and faulty-installation protection reasons, and this invention uses this prior art capability in a new way to allow a novel simplified voltage accurate mode-conversion capability.

FIG. 2 shows both the make-break contacts of the mode switch arrangement, 13, in the open or "off", or first configuration, state. Here the decoder is intended to drive the motor, 8, and the track is clearly not connected directly to the motor. The output voltage state detection and control logic in the decoder detects this first configuration and sets up the decoder for "decoder mode" operation where the decoder H-bridge drives the motor. If both of the make-break contacts of the mode switch arrangement, 13, are changed to the closed or "on", or second configuration state, then the output voltage state detection and control logic in the decoder detects this second configuration and sets up the decoder for "track mode" operation by, at least, disallowing any decoder H-bridge output drive action. This second configuration state is different from any other connection method used by prior art in that the decoder track inputs and motor outputs are intended to be connected and energized at the same time, and this is unacceptable and particularly destructive with prior art methods.

Note that half of the non-pole contacts of a DPDT switch or relay or equivalent device may be employed to provide the needed make-break or Double Pole Single Throw (DPST) connections shown in FIG. 2. However the action of any DPDT switch mechanism employed in this way differs from the prior art because now the decoder output may be connected to the track pickup leads, 3 and 4 while the decoder is also powered by the track. Without output voltage state detection, any decoder with both the input and output both connected to the track (as well as the motor) is subject to destruction if the decoder ever attempts to drive the motor, underlining the fundamental difference of the methods.

Using part of a DPDT switch to effectively be a DPST switch is possible but the DPST switch or contact arrangement, however it is constructed, is fundamentally simpler and less expensive. A double pole (DP) switch arrangement is simply the ganging and synchronizing of two single pole (SP) switches, so it is also possible to create the mode switch arrangement, 13, with two Single Pole Single Throw (SPST) switches or even parts of two Single Pole Double Throw (SPDT) switches. The output voltage state detection is setup in such a way as to be able to detect that both poles of the motor are not connected to the track by a mode switch, i.e. both must be isolated for the decoder to allow itself to drive the motor. If a user incorrectly changes only one of the poles of the mode switch arrangement, 13, into an invalid state not in agreement with the other switch pole, the decoder will correctly infer the motor is not properly isolated and not allow full mode conversion. The decoder can also indicate this error state by flashing light, 9, in a definitive error indicating fashion. The dashed box around the parts of item 13 indicate that the two make-break switch poles enclosed are intended to operate in synchrony as a single unit. Obviously since we are using simple make-break contact structures, the pole marked ends may be connected to either the track feed side, as shown in FIG. 2, or alternately the pole ends may connected on the motor lead side.

While many types of standard switches, dip switches, relays, contactors, jumpers and plug/socket variations are equivalent and usable to realize the mode switch arrangement, 13, this list is not intended to be exhaustive and limiting in the realization of this invention. It is intended that any combination of multiple conductive and insulative elements that are configured to realize an arrangement that operates at least as a two pole make-break structure are usable in the embodiment of this invention. The key characteristics of any switches employed are; relatively low energy losses when employed to carry the motor currents and the ability for the conductive paths to be changed to insulating paths as needed. Low loss non-ohmic contacts and switch elements may also be employed. Any of the well-known command encoding methods and track energy sources may be employed with this invention by those skilled in the art of electronic design. In particular with Radio or Infrared command control systems, the primary commands to the decoder are not transmitted via the tracks and often a battery is provided as the operating energy source so the decoder also does not require energy from the tracks. In these cases this invention is still useful, since the decoder may be configured to selectively change control source when certain types of track voltages or track encoding are detected, and this allows this type of decoder equipped locomotive to run with other locomotives in other mode-conversion situations, which is one of the principal benefits of the invention.

Figure 3:
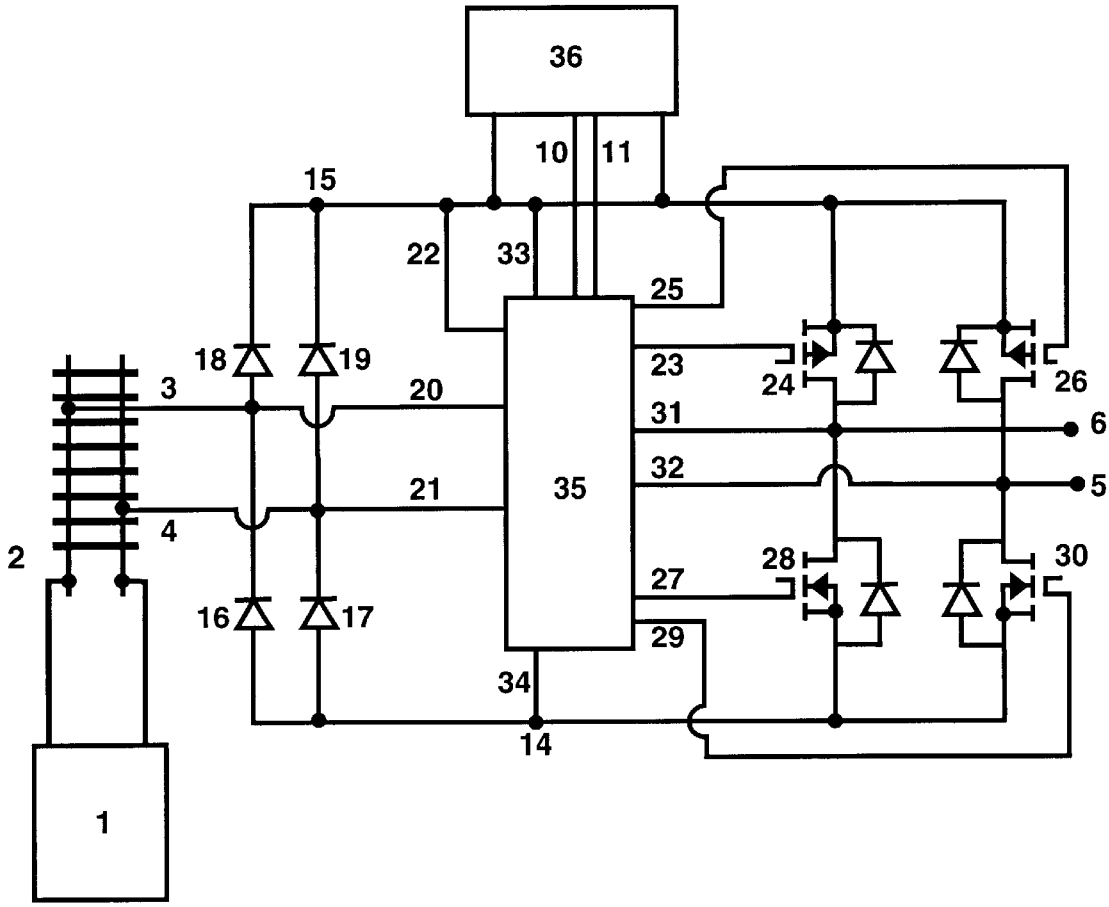

FIG. 3 depicts the major internal elements of a decoder that embodies the spirit of this invention. In particular, it shows new elements that are not present in the Graf prior art basic decoder design. Item 35 represents the internal decoder controller logic, including; a microprocessor CPU, control programs and algorithms, power supply and conditioning logic, memory logic, H bridge driver logic, function and relay driver logic, voltage buffering, filtering and translation logic and other necessary decoder components, known to those competent in the art of decoder design and associated electronic and software design skills. It is not beneficial to show the complexity of all of the possible internal elements and their interconnections because these are generally well known and documented in the field, and the particular new elements and their usage are of importance in this invention.

The form of the decoder in FIG. 3 generally follows conventional and well-known designs. The track pickup leads 3 and 4 connect to the input-rectifying bridge circuit formed by the diodes 16, 17, 18 and 19. These are typically low-loss Schottky diodes and form a negative output voltage on terminal 14 and a positive rectified output voltage at terminal 15. Other types of diodes, or even third-quadrant rectifying MOSFETs may be used to provide this well-known decoder rectifier function.

Track voltage sample connections 20 and 21 obtain samples of voltages from both track leads, 3 and 4, that are conducted to the decoder controller logic, 35. Within the decoder controller logic, 35, the track inputs are typically attenuated and filtered and may be buffered before being finally presented as an input to the microprocessor CPU device. The CPU measures the levels from the track with; logic level comparators, logic thresholds or even Analog to Digital converters, singly or in combination. The measurements of these track voltage levels and timing allows the CPU control program and algorithms to automatically determine the track voltage encoding method in use and allow the CPU to decode the embedded track commands and directives. These are standard practices in the field. Of course the control algorithms and logic implemented by 35 many be functionally implemented in wired logic, a gate array, FPGA or similar method that is not a microprocessor CPU, but these would be equivalent to the preferred embodiment shown here and within the spirit of the invention.

The positive input-bridge output, 15, is conducted to the motor H-bridge source-current drivers, shown as P-channel MOSFETs 24 and 26, which are each controlled from the decoder controller logic, 35, by level-shifted source control lines 23 and 25 respectively. The negative input-bridge output, 14, is conducted to the motor H-bridge sink-current drivers, shown as N-channel MOSFETs 28 and 30, which are each controlled from the decoder controller logic, 35, by sink control lines 27and 29 respectively. MOSFET pair 24 and 28 have their drain terminals connected to drive motor output lead 6, and MOSFET pair 26 and 30 have their drain terminals connected to drive motor output lead 5. This forms the well known H-bridge circuit and is controllable by the four control lines 23, 25, 27 and 29 that are appropriately sequenced by motor controller logic and software in the decoder controller logic, 35. This H-bridge may also be created using bipolar transistors instead of MOSFET transistors. The inherent body diodes of the four MOSFETs are shown in FIG. 3 and these are intentionally used as voltage clamping devices if the motor lead voltages go more positive than the voltage on terminal 15 or more negative than the voltage of terminal 14. Decoder controller logic, 35, receives rectified track energy on positive lead 33 and negative lead 34 and internally filters and regulates this energy to the voltages needed for correct operation. The power for the decoder controller logic, 35, thus is usually derived from the same bridge that supplies the motor H-bridge, although the variation shown by Graf with separate rectifiers connected to the track to provide just the CPU and logic supply is also possible, although redundant.

The decoder elements analyzed so far are representative of the art and follow standard, well-known and established practices.

The addition of motor voltage sample link 31, and 32, provides the new capability needed to best realize this invention. Motor voltage sample link 31, and 32, provide the decoder controller logic, 35, with voltage samples of the voltages at the motor terminals 6 and 5 respectively. These voltage samples are appropriately attenuated, filtered and measured by the CPU in the same manner as voltage samples from track voltage sample connections 20 and 21.

After power on when the track energy supply is first applied, the decoder controller logic, 35, measures the voltages on the motor leads 5 and 6 by employing the capability of motor voltage sample link 31 and 32, while the H-bridge is non-conducting. If the motor is stopped and isolated from the track power by the mode switch arrangement, 13, being set to the "decoder mode" position shown in FIG. 2, then essentially zero voltages will be measured by sample link 31 or 32. Now the CPU determines the motor is properly isolated and if Command Control motor commands are decoded, that the motor may be safely driven by the H-bridge. If the motor voltages are measured as essentially zero then it is certain that the motor is safely isolated for "decoder mode" configuration.

The multiple voltage measurements and their timing are designed to reliably sample the motor and track voltages and allow for possible noise and power interruptions. If the motor is being driven by the decoder and is stopped, it is also possible to continuously sample the motor and track leads to see if the mode switch arrangement, 13, has been changed while track energy is applied. Likewise, if an erroneous determination is mode that the motor is track-connected because of residual motor voltages, a repetitive sampling algorithm will see the motor finally stop and then be able then determine the motor is correctly isolated, then continue correctly.

If the mode switch arrangement, 13, is in the alternate "track mode" setting, then the CPU will measure non-zero voltages on the motor terminals 5 and 6 that appear the same as those measured on the related track terminals 3 or 4. By inspecting these four sets of voltage samples the CPU can use a standard decoding algorithm to determine what type of track energy is present, then determine that essentially the same track voltages appear on the motor terminals, and hence that it is not allowable to drive the motor via the H-bridge and its control lines. Note that the four voltages may all be different, depending on which motor lead is connected to which track feed and the voltage polarity of the track energy source.

The algorithm is simply constructed to analyze the measured voltages to reliably infer the motor connection state and hence configuration. A "track mode" configuration selection allows voltage accurate mode-conversion when the decoder and motor are on conventional track energy sources, and allows safe lash-up or consisting with other conventional locomotives.

During operation the CPU can monitor the ON state voltages (drain to source) of any of the conducting MOSFETs, 24,26, 28 or 30, via links 31 or 32 and determine the ON state voltage across the MOSFET. Since MOSFETs present an effectively resistive ON state, the ON state voltage is a direct measurement of the current the MOSFET is conducting. It is then a simple matter for the CPU to continuously compare a maximum allowable MOSFET ON voltage with an Overcurrent threshold limit and detect an operating fault and turn off the H-bridge to protect it. This represents an extra decoder protection if a motor short-circuit or overload fault, or switch setting changes during operation, or if the switch state was not measured correctly at power on.

Note that the parasitic reverse body diodes of the H-bridge output FETs act as a bridge rectifier from the motor output leads, and are in tandem with the input-rectifying bridge circuit. Since the input-rectifying bridge circuit most typically employs low-loss Schottky rectifiers, the power for the decoder will primarily and preferentially pass via the input-rectifying bridge circuit.

The decoder controller logic, 35, employs an internal power supply and filter that is typically designed to keep the CPU functional during brief dropouts or interruptions of track energy. If the track energy dropout is excessive and the motor was running at the energy interruption, then the CPU will re-power into a motor that is possibly still running because of inertia and hence is acting as a back-emf generator. The mode-conversion and detection algorithm must allow for this in the processing of the motor voltage samples. Note that the motor acting as a generator is less efficient than a motor (due to magnetic gap losses) so the motor generator voltage is always less than the track voltage and will decay in time as the motor slows down with no applied energy. The control algorithms can easily discriminate against this, once this effect is understood to occur.

Additionally the motor terminal voltages of a "track mode" selected motor will be above or below the voltages at internal terminals 14 and 15 by at least the forward voltage drops of the input rectifier bridge diodes. Any slight off-state current leakage from the MOSFETs are allowed for by the shunt impedance of the attenuators employed in sample link 31 and 32, which translate the possible 12 Volt to 30 Volt motor terminal voltages to safe and appropriate levels for the CPU to measure properly. The mode determination measurements of sample link 31 and 32 are initially performed with the H-bridge non-conducting so if the motor is acting as a generator the voltage across the motor may be determined by calculating the difference in the measured terminal voltages. Bridge voltage sample link 22 is also included in the same manner as 20, 21, 31 and 32 so the decoder controller logic, 35, can sample the rectified track energy being applied to the H-bridge. This voltage can be compared to the motor voltage to help determine if the motor is free-wheel generating.

If only one of the make-break switch contact poles is connected (conducting) by error then the two motor leads, 5 and 6, will be essentially measure at the same voltage since the motor impedance is low (typically 10 to 15 ohms) and connects the track connected lead to the non-track connected lead. The algorithm can detect this incorrect partial switch state and correctly disallow motor driving. It is also possible to implement this invention with just a single track voltage sample connection and a single matching motor voltage sample link, since the motor impedance connects the two motor leads and can be checked as described earlier. This variation of the preferred embodiment is operative but is not as reliable as using two of each of the track and motor voltage sample lines.

The exact form of the appropriate attenuators and any filters associated with 20, 21, 22, 31 and 32, voltage samplers and the exact algorithms to be used within the CPU for; command decoding and actuation, H-bridge control, mode determination, decoder protection and other tasks, are not given here because they are easily constructed by those skilled in the art of decoder design from the details of the method presented herein. Implementations that are equivalent to the methods taught herein as the preferred embodiment are considered to be within the scope and spirit of this invention.

Although Graf suggests the use of relay switch contacts to implement the DPDT function of the motor current switching arrangement, 7, there is no teaching of, how the relay may be controlled, the benefits of this capability, or some of the earlier noted programming problems. FIG. 1 shows the addition of a relay on control line, 10, that allows the relay to be turned on by the decoder itself. Graf does not show this addition or control enhancement by the decoder. In particular, the ability of the decoder to sense its operating mode and control the motor connections allows an optimum mode-conversion capability without the inconvenience of a user needing to remove the locomotive body (or shell) to change a jumper setting or switch position, or the need to disguise a switch actuator on the locomotive exterior. This new relay capability may be enjoyed with the switch arrangements of either FIG. 1 or FIG. 2.

If the relay's unpowered state (relay and control line, 10, inactive) occurs when the decoder has insufficient track voltage to operate and the motor is connected through to the track (i.e. "track mode"), then this arrangement will allow this decoded locomotive to optimally and automatically operate with voltage accurate mode-conversion on a conventional track. If the conventional track voltage increases and the decoder becomes operative, it will detect the conventional energy source and not operate the relay. If the track with a full energy Command Control signal, for example DCC, is present the decoder will be quickly energized, detect the DCC control signal and automatically perform a mode-conversion to digital operation by activating relay on control line, 10, to allow the decoder to appropriately control the motor. In the period between initial track energization and relay activation the motor will be connected directly to the track pickups and draw a load current defined by its impedance and the voltage difference between the track voltage and motor rotor back-emf. If the DCC signal is a 0.25-ampere energy limited programming-track signal then programming reliability problems occur with most locomotives.

To solve this problem and still allow automated mode-conversion it is beneficial to employ state-memory in the relay. This may be achieved by changing the simple relay or contactor suggested by Graf into a latching relay or contactor. Here the relay uses a bistable magnetic path arrangement to create a relay with two stable switch states, and that needs no holding power once driven to either latched state. A suitable control algorithm in the decoder decides the preferred Relay State and then drives the relay to that state. The decoder incorporates non-volatile memory that allows it to remember the last Relay State commanded, or it is additionally able to interpret the current Relay State from the output voltage state detection logic in the event the Relay State has been disturbed mechanically into the opposite state.

An example of a suitable relay would be an Omron Electronics Inc. G6SU-2-DC3 miniature DPDT latching relay, which would employ a single coil bipolar drive voltage for relay control on control line, 10. To remove the requirement for a complex bipolar coil drive for 10 to alternately set or reset the relay state with reversed polarity, it is preferred to use a dual coil switched relay version such as the Omron G6SK-2-DC3. To allow this version of relay we add an extra relay off control line, 11, that is employed to reset the Relay State, whilst relay on control line, 10, is used to set the Relay State. Both of these suggested relays are versions with a 3 Volt DC operating voltage that can operate when the track voltage is low. They can also be safely operated at, for example, 12 Volts DC from the decoder since the operate time is only approximately 4 milliseconds and the increased operate current is turned off after this operate time has elapsed so that no heat or overcurrent damage can occur.

Other coil voltages, and styles of latching switch or contactor mechanisms may be used and other terminal and mounting configurations are possible, but all these variations operate in the manner described herein. FIG. 3 shows the addition of relay, 36, with set control line 10 and reset control line 11 connected to the decoder controller logic, 35, which incorporates the required relay driver logic components. Relay 36 is also connected to terminal 15 for a positive source of switching energy for both possible relay coils. The DPDT switched relay contacts of 36 are not shown in FIG. 3 to avoid clutter in the drawing, but it is to be clearly understood that these DPDT contacts of relay 36 are employed to create suitable current switching arrangements equivalent to the elements enclosed within the dashed-boxes in FIG. 2, or even FIG. 1. If a single coil bipolar latching relay or a non-latching relay is used for 36 then control line 11 and its positive supply connection are simply not implemented.

To best use the latched relay capability, the decoder employs an intelligent algorithm to decide when to change the Relay State. If the unit encounters Command Control signals it clearly should change the relay so as to control the motor from the decoder. If conventional track power is seen, several possibilities occur. If the user wants accurate mode-conversion to DC then the relay will change so the motor is powered directly by the track. The user may optionally setup a new control Configuration Variable such that he decoder control algorithm employs automatic decoder-driven motor DC mode-conversion so as to be compatible with other decoder locomotives that do not have voltage accurate mode-conversion capability, and allow these to be linked or consisted with no speed mismatch.

If AC voltage type conventional power is detected then the decoder will typically retain direct control of the motor and interpret the direction and speed information from the type of AC control signals detected, i.e. whether high voltage AC pulse or direction cycle on voltage-off periods. The 3-wire type of AC motors may be driven by the decoder using well known connection methods, or extra relay poles may be added to switch the AC motor to operate with an original type of control unit.

It is possible to now reliably operate the decoder equipped locomotive on a NMRA RP9.2.3 programming-track by first briefly touching the locomotive to a normal DCC powered track section after the locomotive has been used on conventional power track. This will now latch the DCC state and ensure that when the locomotive is moved to a separate energy-limited programming-track that the motor will be connected to the decoder output and not cause an excessive current draw on the programming-track. This ensures programming reliability without the user having to open the locomotive's shell to change switch settings or similar inconvenience.

When a decoder equipped locomotive that is latched to the DCC state is placed on conventional track, the unit will briefly operate as a non-accurate mode-conversion unit until the track voltage enables the decoder to detect conventional power and change the relay for accurate mode-conversion, if selected. All subsequent conventional track operations will be accurate, until the locomotive is again cycled back from a DCC track or layout. In this manner the use of a latching relay controlled by an intelligent algorithm within the decoder provides improved layout capabilities, and the ability to move decoder equipped locomotives freely from different track control methods and still allow speed-matched or voltage accurate lash-ups or consists with other technology locomotives.

Having thus disclosed the preferred embodiment and some alternatives to this embodiment, additional variations and applications for this invention will be apparent to those skilled in the art of decoder and electronic design, with minimal extra effort. Therefore, while the disclosed information details the preferred embodiment of the invention, no material limitations to the scope of the claimed invention are intended and any features and alternative designs that would be obvious to one of ordinary skill in the art are considered to be incorporated herein.

Consequently, rather than being limited strictly to the features disclosed with regard to the preferred embodiment, the scope of the invention is set forth and particularly described in the following attached claims.

What is claimed is:

1. A method for providing voltage accurate mode-conversion for a model railroad decoder connected to a motor means and to layout tracks, comprising at least:

a) providing said model railroad decoder, comprising at least:

(i) an input-rectifying bridge means connected to two track pickup leads, (ii) a decoder controller logic means capable of at least executing control and detection algorithms based on voltage sample measurements, (iii) an H-bridge control means, controlled by said decoder controller logic means, with two output leads individually connected to two motor leads of said motor means, (iv) a track voltage sample connection means to provide track voltage samples to said decoder controller logic means, (v) a motor voltage sample link means to provide motor voltage samples to said decoder controller logic means, b) providing said motor means, c) providing a mode switch arrangement means with make-break electrical connections that selectively and individually connect each one of said two track leads to just one of said two motor leads of said motor means, whereby measuring of said track voltage samples and said motor voltage samples by said executing control and detection algorithms based on voltage sample measurements, allows said model railroad decoder to detect the connection configuration of said mode switch arrangement means and to not allow operation of said H-bridge control means if any of said two motor leads is connected directly to any of said two track leads, thus permitting accurate voltage mode-conversion on conventional energy track power and compatible operation coupled to other conventional locomotives.

2. The method defined in claim 1 wherein detection of isolated motor configuration when none of said two motor leads is connected directly to any of said two track leads, and a valid command control track encoding present on the track by said control and detection algorithms executing in said model railroad decoder allows operation of said H-bridge control circuit and permits normal command control track actions.

3. The method defined in claim 1 wherein two track voltage sample connection means are employed to provide track voltage samples from each one of said two track leads to said decoder controller logic means.

4. The method defined in claim 1 wherein two motor voltage sample link means are employed to provide motor voltage samples from each one of said two motor leads to said decoder controller logic means.

5. The method defined in claim 1 wherein said control and detection algorithms based on voltage sample measurements are employed on a continuous basis to detect and safely respond any changes of configuration of said mode switch arrangement means.

6. The method defined in claim 1 wherein said control and detection algorithms based on voltage sample measurements employ noise rejection and filtering capability to ensure reliable detection of configuration of said mode switch arrangement means.

7. The method defined in claim 1 wherein said control and detection algorithms based on voltage sample measurements employ the capability of detecting motor back-emf to ensure reliable detection of configuration of said mode switch arrangement means.

8. The method defined in claim 1 wherein said mode switch arrangement means is implemented with a device selected from the group consisting of a DPDT slide switch and a DPST slide switch and a DPDT toggle switch and a DPST toggle switch and a DPST Dip switch and a DPDT Dip switch and a two pole jumper plug and a two pole header strip and a DPST press-switch and a two pole two position rotary switch and two single pole Dip switches.

9. The method defined in claim 1 wherein said mode switch arrangement means is implemented with a relay switch means controlled by said model railroad decoder.

10. The method defined in claim 9 wherein said relay switch means employs a latching relay capable of selection to both relay states by said model railroad decoder.

11. The method defined in claim 10 wherein said model railroad decoder is configurable to select between voltage accurate mode-conversion and automatic decoder-driven motor mode-conversion when connected to conventional track energy.

12. The method defined in claim 10 wherein said selection to both relay states is controlled by an algorithm executing in said model railroad decoder that permits reliable programming-track programming of said model railroad decoder.

13. An apparatus for allowing voltage accurate mode-conversion of a model railroad decoder connected to a motor and to layout tracks, comprising:

a) said motor with two motor leads, b) a mode switch arrangement with make-break electrical connections that selectively and individually connect each one of two track leads to just one of said two motor leads of said motor, c) said model railroad decoder, further comprising:

(i) an input-rectifying bridge connected to said two track pickup leads and which rectifies track voltages, (ii) a decoder controller logic means that executes control and detection algorithms based on voltage sample measurements and that can detect the motor connection configuration, (iii) an H-bridge control circuit controlled by said decoder controller logic means, with two output leads individually connected to said two motor leads, (iv) a track voltage sample connection to provide track voltage samples to said decoder controller logic means, (v) a motor voltage sample link to provide motor voltage samples to said decoder controller logic means, whereby said model railroad decoder detects the connection configuration of said mode switch arrangement and will not allow operation of said H-bridge control circuit if any of said two motor leads is connected directly to any of said two track leads, thus permitting safe and accurate voltage mode-conversion on conventional energy track power, and compatible operation coupled to other conventional locomotives.

14. The apparatus defined in claim 13 wherein detection of isolated motor configuration and valid command control track encoding by said control and detection algorithms executing in said model railroad decoder allow operation of said H-bridge control circuit and permits normal command control track actions.

15. The apparatus defined in claim 13 wherein said mode switch arrangement is implemented with a relay switch device controlled by said control and detection algorithms executing in said model railroad decoder.

16. A method for providing an automated mode selection capability to a decoder connected to a motor means and to layout tracks, comprising at least:

a) providing said motor means with two motor leads, b) providing said model railroad decoder, comprising at least:

(i) an input-rectifying bridge means connected to two track pickup leads, (ii) a decoder controller logic means capable of at least executing control and detection algorithms based on voltage sample measurements, (iii) an H-bridge control means, controlled by said decoder controller logic means, with two motor output leads, (iv) a track voltage sample connection means to provide track voltage samples to said decoder controller logic means, (v) providing a relay control line means controlled by said control and detection algorithms based on voltage sample measurements, c) providing a relay mode switch arrangement means with changeover electrical connections with two control configurations selectable by said a relay control line means, a First configuration that connects said two track pickup leads to said two motor leads, and a Second configuration that connects said two motor output leads to said two motor leads, whereby measuring of said track voltage samples by said executing control and detection algorithms based on voltage sample measurements, allows said model railroad decoder to detect the track command encoding method in use and select the appropriate configuration of said relay mode switch arrangement means, thus permitting accurate voltage mode-conversion when operating on conventional energy track power and speed compatible operation if coupled to other conventional locomotives.

17. The method defined in claim 16 wherein detection of command control voltages on the track by said executing control and detection algorithms based on voltage sample measurements selects relay mode switch arrangement means to said Second configuration that connects said two motor output leads to said two motor leads and allows decoder control of said motor means.

18. The method defined in claim 16 wherein said relay mode switch arrangement means employs a latching relay capable of selection to both relay states by said model railroad decoder.

19. The method defined in claim 16 wherein said selection to both relay states is controlled by an algorithm in said model railroad decoder that permits reliable programming-track programming of said model railroad decoder.

* * * * *